US007934757B2

(12) United States Patent
Boutte

(10) Patent No.: US 7,934,757 B2
(45) Date of Patent: May 3, 2011

(54) HYDRAULIC CRANE-MOUNTED REMOTELY-CONTROLLED LIFTING DEVICE

(76) Inventor: Tierson K. Boutte, Atlanta, GA (US)

( * ) Notice: Subject to any disclaimer, the term of this patent is extended or adjusted under 35 U.S.C. 154(b) by 298 days.

(21) Appl. No.: 12/223,314

(22) PCT Filed: Feb. 1, 2007

(86) PCT No.: PCT/US2007/002691

§ 371 (c)(1),
(2), (4) Date: Jul. 29, 2008

(87) PCT Pub. No.: WO2007/092236

PCT Pub. Date: Aug. 16, 2007

(65) Prior Publication Data

US 2009/0065093 A1 Mar. 12, 2009

(51) Int. Cl.
*B66C 1/42* (2006.01)

(52) U.S. Cl. ..... 294/88; 294/106; 294/905

(58) Field of Classification Search ..... 294/88, 294/106, 905, 82.15; 414/745.2, 909
See application file for complete search history.

(56) References Cited

U.S. PATENT DOCUMENTS 3,310,335 A * 3/1967 Shuey ..... 294/88
3,540,770 A 11/1970 Mitchell
3,647,255 A 3/1972 Hale et al.
3,655,232 A * 4/1972 Martelee ..... 294/67.33
3,759,564 A * 9/1973 Seaberg ..... 294/88
3,774,954 A * 11/1973 Taguchi et al. ..... 294/68.23
4,129,329 A * 12/1978 Longo ..... 294/68.23
4,303,269 A 12/1981 Faughnan
4,381,872 A 5/1983 Hahn
4,526,413 A * 7/1985 Williams ..... 294/88
5,088,610 A 2/1992 Garnier
5,209,536 A * 5/1993 Rogers et al. ..... 294/88
5,653,350 A 8/1997 Maki
6,019,406 A * 2/2000 McDermott et al. ..... 294/81.51
7,195,296 B2 * 3/2007 Swift et al. ..... 294/68.24
2003/0015251 A1 1/2003 Moon et al.

FOREIGN PATENT DOCUMENTS

GB 859402 1/1961

* cited by examiner

*Primary Examiner* — Dean J Kramer
(74) *Attorney, Agent, or Firm* — Richard C. Litman

(57) ABSTRACT

The hydraulic crane-mounted remotely-controlled lifting device (10) includes a housing (26) having hydraulically-operated, grasping members (16), (44, 46) that will permit the removal of limbs from the trunk of the tree without having a climber to move out on each limb to secure the lifting device (10). The device (10) can be easily attached and detached from the end of the crane's cable (12) and requires no other physical connection to the crane other than the cable. The device (10) is self-contained in that all hydraulic mechanisms (30, 32), including an electric power source (34) for operating the hydraulic mechanisms, are enclosed in the housing (26). A wireless control device (22) permits the crane operator to position the pair of grasping members around the designated tree limb from a remote position.

5 Claims, 6 Drawing Sheets

HYDRAULIC CRANE-MOUNTED REMOTELY-CONTROLLED LIFTING DEVICE

TECHNICAL FIELD

The present invention generally relates to lifting devices. More specifically, the present invention is drawn to a hydraulic crane-mounted remotely-controlled lifting device especially adapted for tree removal.

BACKGROUND ART

As our urban areas age, trees planted many years earlier have reached maturity, and many have become very large. While large trees are an asset and enhance the aesthetics of the crowded urban environment, problems arise when the trees must be removed because of damage, disease, landscape management programs, new construction, etc. In such instances, a tree removal company is usually hired to effect the tree removal.

Typically, the tree removal company utilizes a hydraulic crane in this tight and crowded environment. Crane use allows parts of the tree to be removed without the tree parts crashing to the ground and prevents the felled tree from causing damage to the landscape and adjacent structures. One of the most time-consuming and dangerous aspects of tree removal using hydraulic cranes is the individual rigging from the hook end of the cable to each tree limb. This endeavor requires a climber to "tie in" high above the rigging point and make his way out to the middle of the limb to attach the hook to the limb. This process must be repeated for each limb to be removed. The art would certainly welcome a device that would allow this precarious and time-consuming process to be circumvented. Thus, a hydraulic crane-mounted remotely-controlled lifting device solving the aforementioned problems is desired.

DISCLOSURE OF INVENTION

The disclosure is directed to a crane-mounted, remotely-controlled, lifting device. The device includes a pair of grasping members and associated hydraulic cylinders that are mounted on a housing. The hydraulic cylinders are attached to the grasping members and selectively move the grasping members. A power unit contained in the housing moves the hydraulic cylinders, and an electric power source that is also located within the housing operates the power unit.

The disclosure is further directed to a crane-mounted, remotely-controlled, lifting device that is configured so that a cable attaches the crane to the lifting device. The lifting device includes a spindle that is adapted for attachment to a cable. The spindle and a pair of grasping members are mounted to a housing. Hydraulic cylinders are also mounted to the housing and are attached to the grasping members for selectively moving the grasping members. A power unit in the housing is used for moving the hydraulic cylinders. An electrical power source in the housing operates the power unit.

BRIEF DESCRIPTION OF THE DRAWINGS

Similar reference characters denote corresponding features consistently throughout the attached drawings.

BEST MODE FOR CARRYING OUT THE INVENTION

The present invention is drawn to a hydraulic crane-mounted remotely-controlled lifting device that will permit the removal of limbs from the trunk of the tree without having a climber move out on each limb to secure the lifting device. The device can be easily attached and detached from the end of the crane's cable and requires no other physical connection to the crane other than the cable. The device is self-contained so that all hydraulic mechanisms, including an electric power source for operating the hydraulic mechanisms, are enclosed in the housing. The housing also supports the grasping members of the lifting device. A wireless control device permits the crane operator or other user to position the grasping members around the designated tree limb from a remote position. Thus, all the responsibility of rigging and raising the tree limb is controlled by the crane operator, thereby eliminating the chances for mishap and injury to a climber. Furthermore, the device allows the limb to be set down in a predetermined staging area where the limbs can be de-rigged without intervention from a ground crew.

Accordingly, the invention presents a grappling device that can be remotely controlled and allows an operator to rig and lift a tree limb without the use of a climber. The device incorporates embodiments that would permit the rigging and lifting of objects of configurations other than that of tree limbs. The invention provides for improved elements in an arrangement for the purposes described that are inexpensive, dependable and fully effective in accomplishing their intended purposes.

Figure 1:
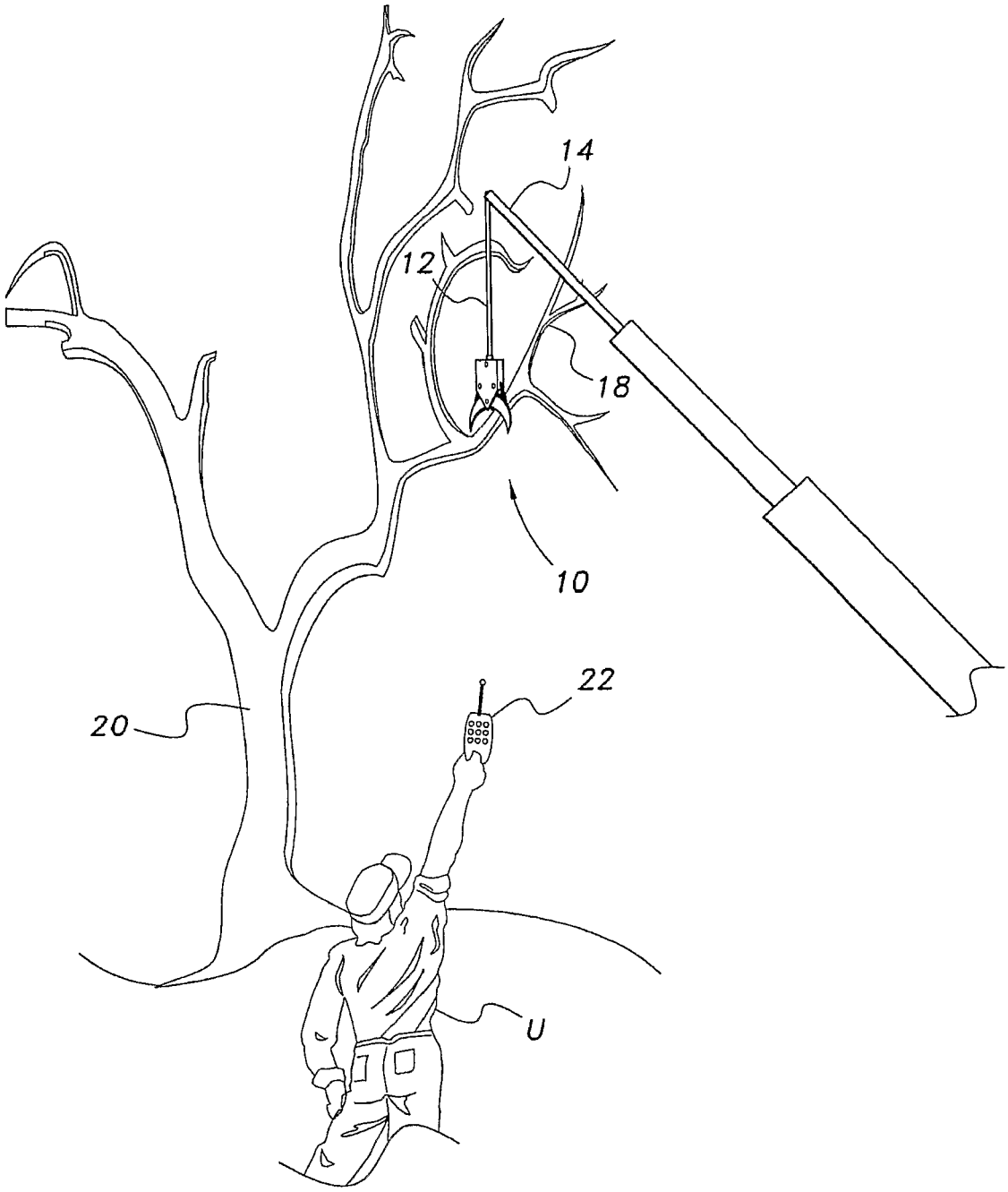
FIG. 1 is an environmental, perspective view of a hydraulic crane-mounted remotely-controlled lifting device according to the present invention.

Attention is first directed to FIG. 1 wherein the hydraulic crane-mounted remotely-controlled lifting device of the present invention is generally indicated at 10. Lifting device 10 is attached to, and suspended from, the end of a cable 12. Cable 12 is movably secured on the boom 14 of a crane (not shown), as is conventional in the art. The tongs of lifting device 10 grasp the limb 18 of tree 20. When the limb 18 is cut adjacent the trunk of tree 20, the severed limb can easily be lowered to a designated area. The entire operation of the lifting device 10 can be controlled by a user U wielding a remote control unit 22.

Figure 2:
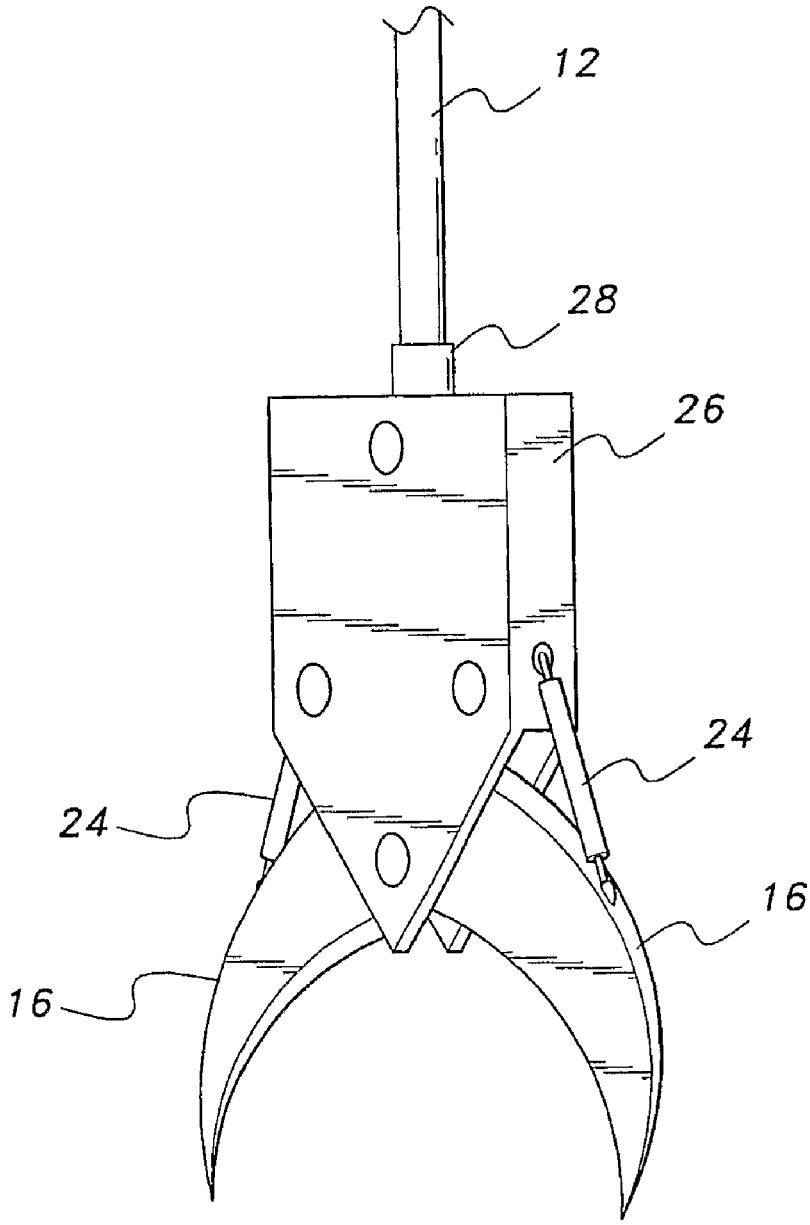
FIG. 2 is a perspective view of the control housing and tongs of a hydraulic crane-mounted remotely-controlled lifting device according to the present invention.
Figure 3:
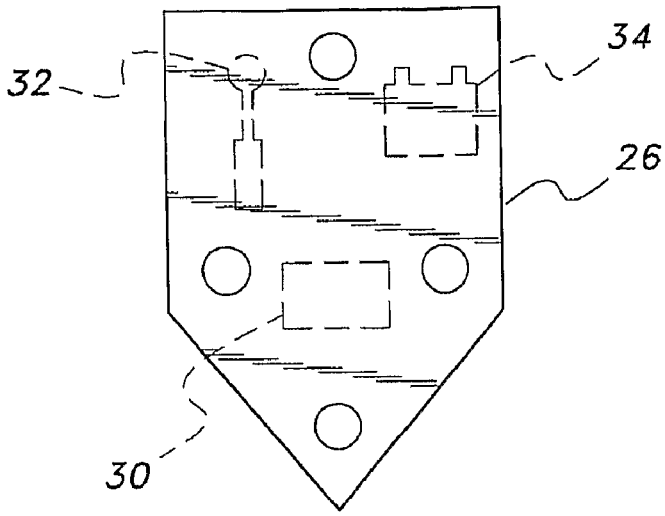
FIG. 3 is a plan view of the control housing of a hydraulic crane-mounted remotely-controlled lifting device according to the present invention.

As best seen in FIGS. 2 and 3, lifting device 10 comprises a pair of gripping tongs 16 movably mounted via high-pressure, hydraulic cylinders 24 to housing 26. To ensure safety, it is recommended that the device 10 only be employed to grasp limbs that can be completely encompassed by tongs 16, as it would be unsafe to attempt to grip large limbs in tweezers-like fashion. As presently contemplated, the tongs 16 can be opened to grasp a limb having a maximum diameter of 18". The device 10 can be easily attached and detached from the cable 12 by means of a suitable quick-connect coupler or spindle 28. All necessary mechanisms to manipulate the tongs 16 are contained in housing 26. Such mechanisms include a receiver 30 for receiving signals from remote unit 22; an integrated, valve-powered unit 32 for providing hydraulic power to operate cylinders 24; and a 12-volt battery 34 for supplying electrical power to operate unit 32.

Figure 4:
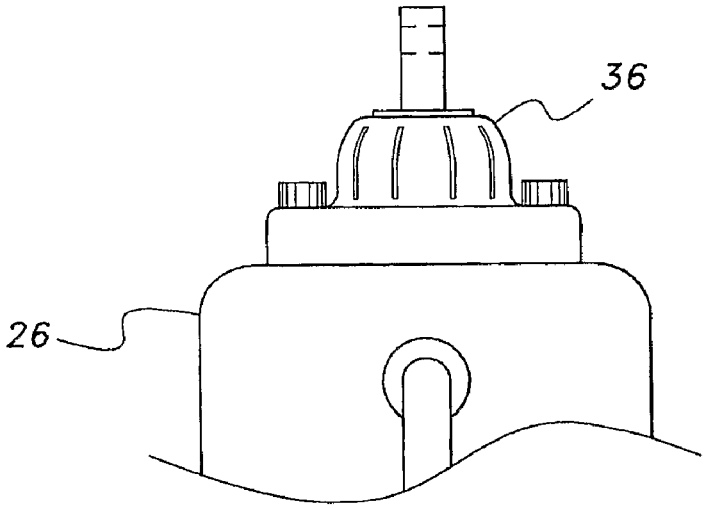
FIG. 4 is a partial view of a second embodiment of the control housing of a hydraulic crane-mounted remotely-controlled lifting device according to the present invention.

A second embodiment of the invention, as illustrated in FIG. 4, includes a hydraulic motor 36 mounted atop housing 26. Quick-connect spindle 28 is mounted to hydraulic motor 36 and is rotated thereby. Motor 36 can also be operated from the remote control unit 22. This arrangement permits the user to rotate housing 26 for better positioning relative to the limbs of the tree.

Figure 5:
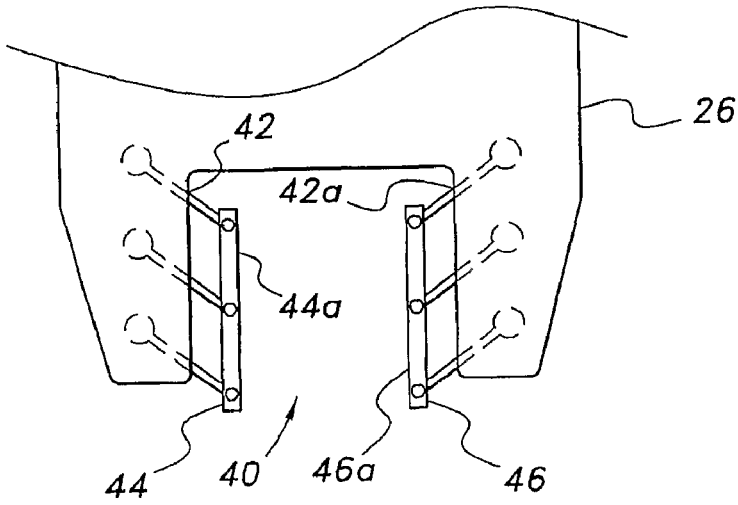
FIG. 5 is a partial view of a second embodiment of the grapple structure of a hydraulic crane-mounted remotely-controlled lifting device according to the present invention.
Figure 6:
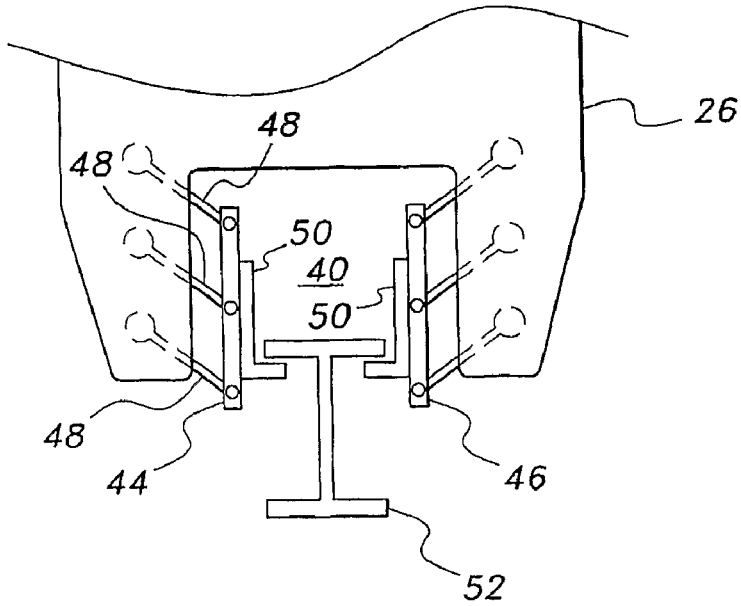
FIG. 6 is a partial view showing inserts for lifting an I-beam incorporated in a second embodiment of the grapple structure of a hydraulic crane-mounted remotely-controlled lifting device according to the present invention.
Figure 7:
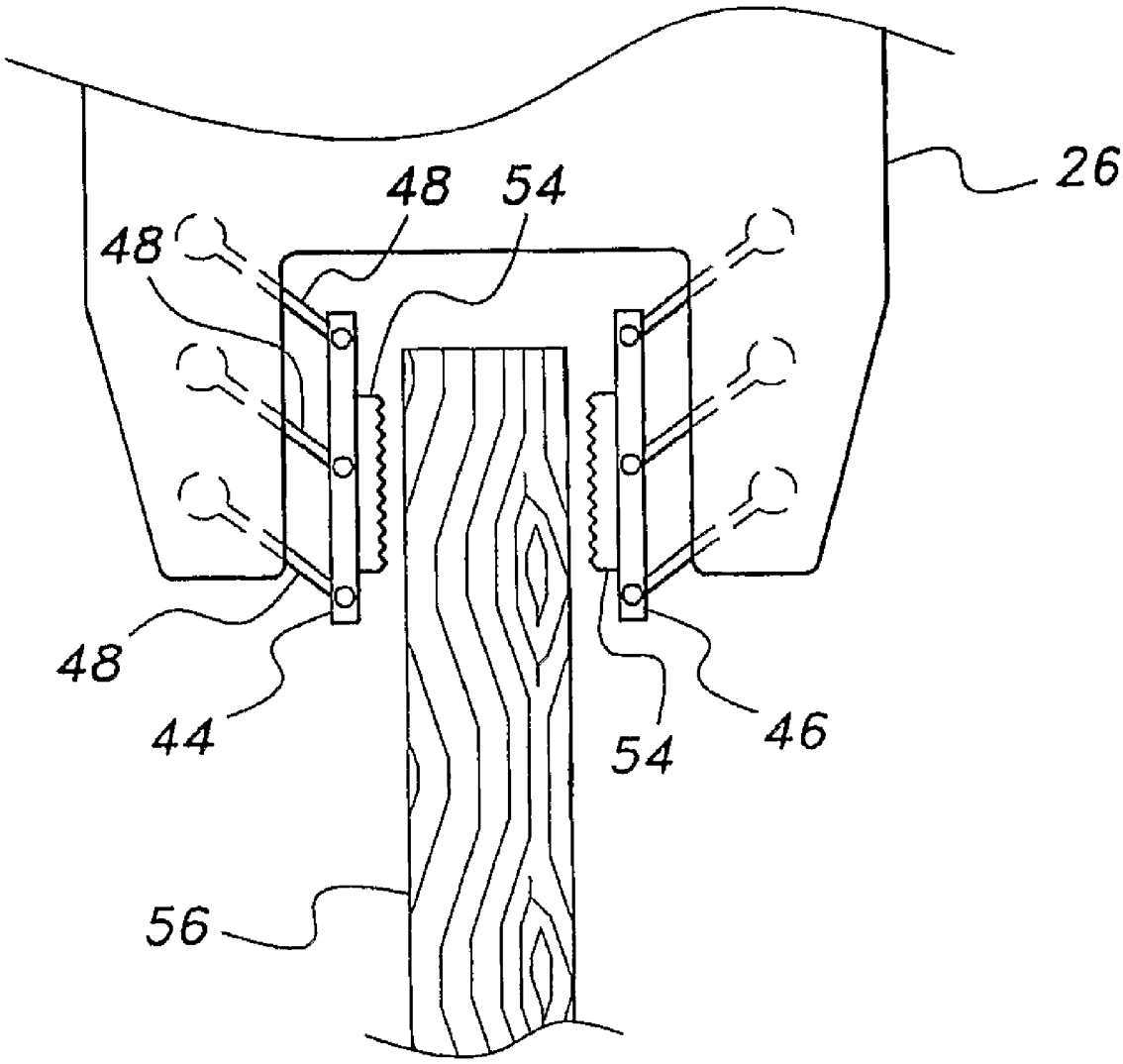
FIG. 7 is a partial view showing inserts for lifting a wooden truss incorporated in a second embodiment of the grapple structure of a hydraulic crane-mounted remotely-controlled lifting device according to the present invention.

Although described above as a device to enhance tree removal and lift severed tree limbs, it is obvious that the device can be employed in a myriad of lifting situations. FIGS. 5-7 illustrate an embodiment of the invention wherein housing 26 is modified to incorporate a cavity 40 therein. Cavity 40 is formed with a pair of spaced, parallel, vertical walls 42, 42*a*. Respective hydraulically-operated jaws 44, 46 are movably mounted adjacent each respective vertical wall. Jaws 44, 46 are moved by a hydraulic piston and guide arrangement 48. Each jaw is designed with a respective planar inner surface 44*a*, 46*a*. The surfaces 44*a*, 46*a* are spaced apart and arranged in parallel to each other. Each surface 44*a*, 46*a* is adapted to have an insert mounted thereon. Any conventional, suitable and convenient means (screws, nuts, bolts, etc.) may be employed to mount the inserts to the surfaces 44*a*, 46*a*. The inserts may include L-shaped members 50 to allow lifting of an I-beam 52 or serrated members 54 to allow lifting of a wooden truss 56. It is obvious that other insert types may be utilized dependent on the configuration of the object to be lifted.

Figure 8:
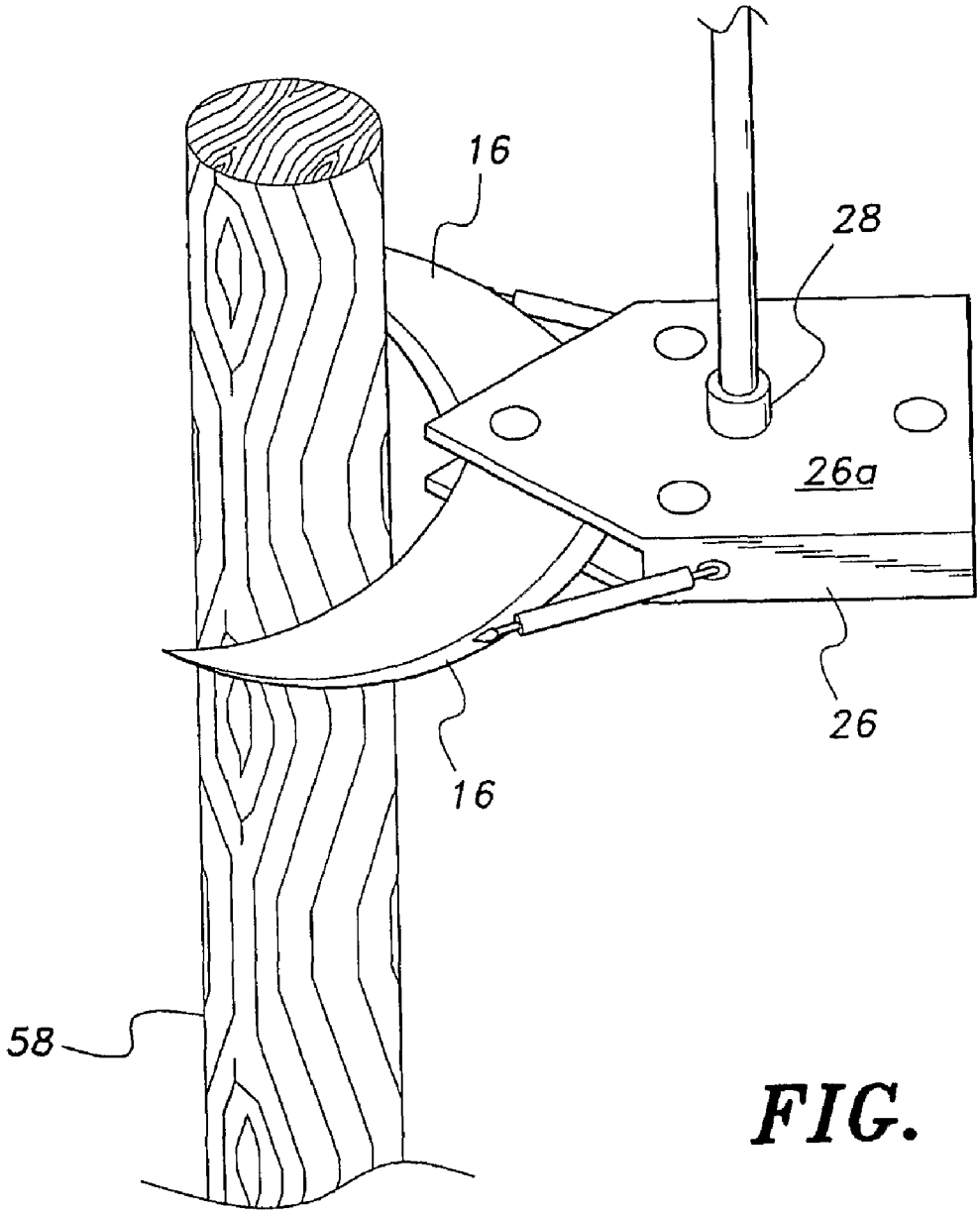
FIG. 8 is a partial perspective view of a third embodiment of a hydraulic crane-mounted remotely-controlled lifting device according to the present invention, showing the device positioned to lift vertically-oriented objects according to the present invention.

FIG. 8 discloses an embodiment of the invention wherein the quick-connect spindle 28 is mounted on a side 26*a* of housing 26, transverse to tongs 16. This arrangement permits the device 10 to grasp and lift vertically-oriented objects 58.

It is to be understood that the present invention is not limited to the embodiments described above, but encompasses any and all embodiments within the scope of the following claims.

The invention claimed is:

1. A crane-mounted, remotely-controlled, lifting device, the crane having a cable for attachment to the lifting device, the lifting device comprising:

a housing having a top portion, a bottom portion, and a pair of side surfaces defining substantially planar surfaces;

a spindle mounted on said housing at the top portion, the spindle being adapted for attachment to the cable;

a pair of arcuately-shaped grasping members mounted to said housing at the bottom portion;

hydraulic cylinders mounted to said housing adjacent to the bottom portion and directly attached to said pair of grasping members for selectively moving each of said grasping members about distinct planes substantially parallel to said pair of side surfaces;

a power unit contained in said housing for moving said hydraulic cylinders;

an electric battery contained in said housing for operating said power unit;

a remote control device for sending a signal to said housing; and a receiver contained in said housing for receiving the signal from said remote control device.

2. The lifting device according to claim 1, further including a hydraulic motor mounted on the top surface of said housing, said spindle being rotatable by said hydraulic motor.

3. The lifting device according to claim 1, wherein said grasping members are a pair of tongs.

4. The lifting device according to claim 1, wherein said grasping members are a pair of jaws.

5. The lifting device according to claim 1, wherein said spindle is mounted on one of said pair of side surfaces and transverse to said pair of grasping members.

* * * * *